United States Patent [19]

Whyatt

[11] 4,058,916

[45] Nov. 22, 1977

[54] OBJECT RETAINING AND DISPLAY CALENDAR

[76] Inventor: Roy Whyatt, 105 Bellvue St., Newton, Mass. 02158

[21] Appl. No.: 719,941

[22] Filed: Sept. 2, 1976

[51] Int. Cl.[2] ..... G09D 3/00

[52] U.S. Cl. ..... 40/107; 40/110; 206/.84; 232/5

[58] Field of Search ..... 40/107, 110, 109, 122, 40/120; 206/.8–.84; 229/87.2, 92.9; 232/5

[56] References Cited

U.S. PATENT DOCUMENTS

| | | | |
|---|---|---|---|
| 847,652 | 3/1907 | Creasey | 40/107 X |
| 1,281,809 | 10/1918 | Moreland | 40/107 X |
| 2,521,792 | 9/1950 | Hollander | 229/92.9 |
| 2,863,603 | 12/1958 | Doupnik | 232/5 |
| 3,207,421 | 9/1965 | Hunger et al. | 40/107 X |
| 3,313,477 | 4/1967 | Brown | 232/5 |

FOREIGN PATENT DOCUMENTS

| | | | |
|---|---|---|---|
| 991,128 | 6/1951 | France | 40/107 |

*Primary Examiner*—John F. Pitrelli
*Attorney, Agent, or Firm*—William Nitkin

[57] ABSTRACT

An object retaining and displaying calendar having date areas associated with each day of the month and object retaining means associated with each date area. In one embodiment the calendar comprises a structure which includes a plurality of channels defined therein, each channel to contain objects to be displayed in association with an individual sequential day of the month.

7 Claims, 10 Drawing Figures

OBJECT RETAINING AND DISPLAY CALENDAR

BACKGROUND OF THE INVENTION

The device of this invention relates to calendars having retaining means for the visual display of a plurality of objects, one associated with each date of the month, and more particularly relates to a calendar for the holding of money so that the device can be used in the dual role of a calendar-bank.

Calendars have long been in use by the general public. Some of the different kinds of calendars in common use are desk calendars having flippable pages for each day of the year; wall calendars covering various calendar periods; bound monthly calendars; perpetual calendars which can be set manually to the correct day, month and year; referral calendars with which one can refer to different months within past or future years; desk pad calendars which fit into a desk blotter; weekly appointment books; and calendar diaries. In many of these calendars rectangular spaces define date areas for each day of the month and many calendars have portions of these date areas blank for the user to write notations therein. Typically many of the above mentioned calendars include messages printed on portions of these dates areas to remind the user of important dates such as legal holidays, tax deadlines, etc.

There are also a great many designs of devices for holding coins and dollar bills. There is, of course, the standard "piggy bank," and devices which hold coins stacked in columns such as change makers which can be used by bus drivers and in stores for the automatic return of correct change. The device of this invention can be used to combine both the functions of a daily calendar and a bank in one structure to encourage the saving of money on a daily basis. In other embodiments of the device of this invention other objects can be displayed within its retaining means.

SUMMARY

The device of this invention is a calendar which has retaining means for the display of a plurality of objects, one of which is displayed in association with the current day of the month. The calendar of this invention can be used decoratively as an educational tool, a calendar-bank, or can be utilized for commercial and promotional purposes and have, for example, coupons as objects associated with each date area that become valid on the current day of the month. These coupons can be removed and used as they become valid. This calendar can also be designed with special interest groups in mind, such as horticultural societies, for which pictures and information pertaining to flowers could be incorporated onto the objects to be retained and displayed on the calendar.

In one embodiment the structure of this device forms a wall-hanging calendar having a plurality of date areas, each associated with and appropriately numbered for each day of the month. The retaining means in this embodiment can be pocket-like receptacles, insertion slots, or equivalent means for the retention of objects such as coins, paper money, insertable cards having pictures of animals, flowers, etc., coupons, or other equivalent objects. The calendar device can encompass a single month of the year, several months of the year, or the calendar can be a permanent calendar with interchangeable calendar year indicia insertable therein.

The calendar, in a second embodiment, can be self-supporting and have calendar indicia, and a plurality of date areas, each associated with and appropriately numbered for each day of a month. In this embodiment the calendar comprises a structure in which the retaining means of the calendar consist of a plurality of parallel channels, each at the same angle to the horizontal, each of the channels having an opening at one end, and the channels being separated from one another by channel dividers. Overlaid onto the plurality of channels and channel dividers is a front support member on which can be imprinted the appropriate numbers of the days of the month arranged at the same angle of incline to the horizontal as the plurality of channels are arranged. These numbers can be equivalently imprinted onto the front of the back support member. Sealing the side opposite the channel openings is a side support member which prevents the objects inserted into the channels from falling out. Coins inserted into the channels' openings will roll down the slight incline by gravity to a position behind the number of the current day of the month. The front support member can be constructed of a transparent material. In the calendar bank embodiment, it is envisioned that the month and year indicia can be removable and interchangeable so that the calendar's use will not be limited to a particular month or year. It is further envisioned that on each day of the month, the user of this calendar can insert a coin or similarly shaped disk which will roll into position behind the correct number of the day of the month until all the days of the month have a coin in place. At this the point calendar-bank is completely filled and can be emptied by tipping the device causing the coins to roll out through the channel openings. These coins can then be deposited into a savings bank.

In one embodiment of this self-supporting calendar device, instead of the calendar indicia being imprinted on the front support member or on the back support member, the calendar indicia can be imprinted on a sheet of transparent material to form a transparent date sheet. A space between the front support member and the channel dividers can be provided for insertion of this transparent date sheet. Seven different monthly transparent date sheets are required, each sheet having the first day of the month positioned on a different day of the seven weekdays. These transparent date sheets can be imprinted in the configuration of standard calendars and can be utilized in conjunction with a peg system wherein the front support member and each transparent date sheet has an aperture before the first day of the month for receipt of a peg. When the appropriate monthly transparent date sheet is in position between the front support member and the channel dividers, a peg can be inserted through both the aperture in the front support member and the transparent date sheet before the corresponding first date of the month thereby preventing the coins or other objects inserted from rolling to the end of the channel. The coins or other objects will be retained behind the appropriate date of the month.

When coins or paper money are used as objects to be inserted into the retaining means of these embodiments, the calendar device of this invention can be utilized as a calendar-bank to encourage the saving of money on a daily basis.

DESCRIPTION OF THE PREFERRED EMBODIMENT

Figure 1:
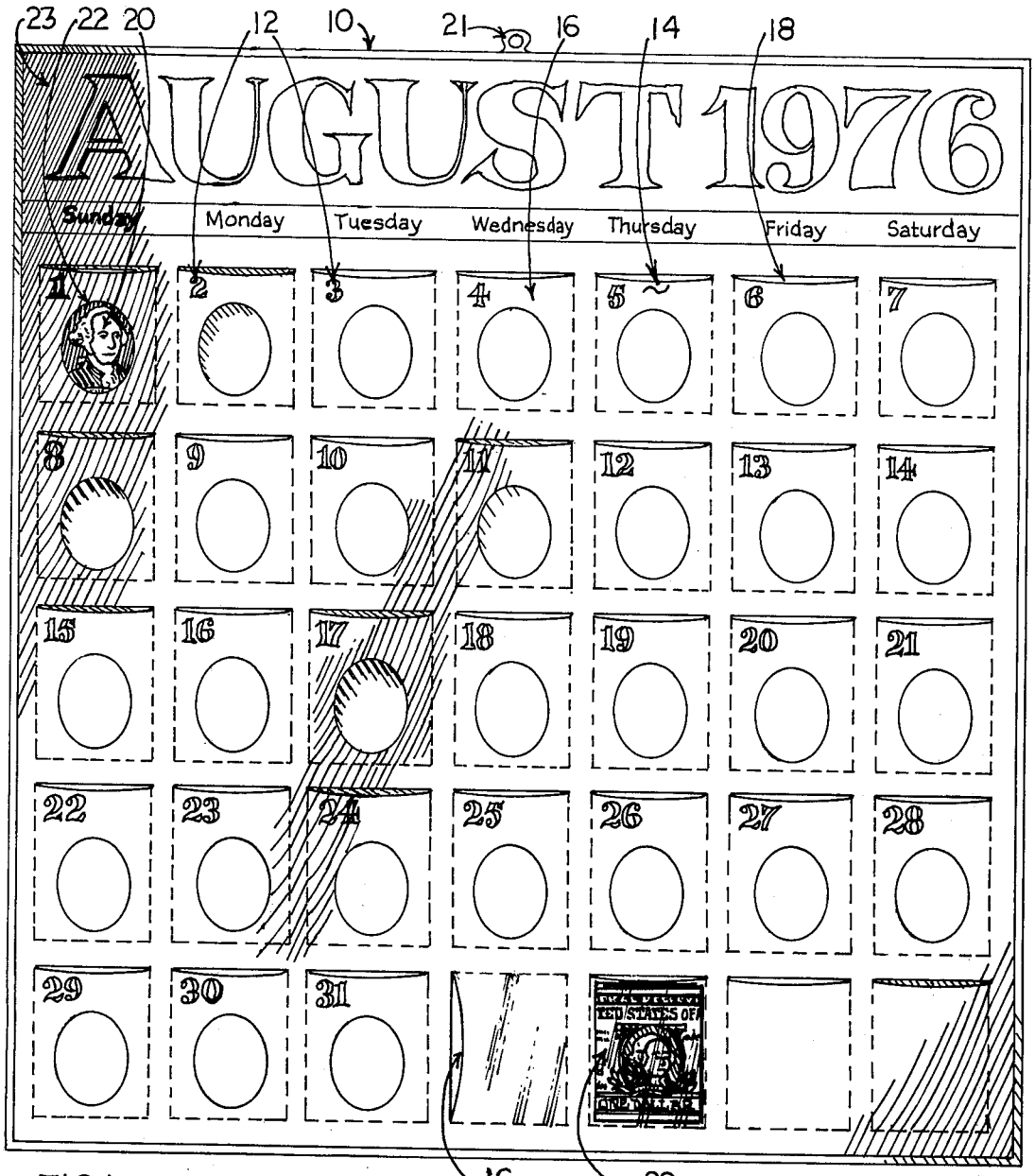
FIG. 1 illustrates a front view of an embodiment of the calendar device of this invention having pocket-like receptacles as retaining means.

FIG. 1 illustrates a front view of an embodiment of the calendar device of this invention utilizing a plurality of pocket-like receptacles as retaining means. It is envisioned that back support member 10 of the calendar can be made of sturdy paper, cardboard, or equivalent stiff material. Front retaining member 23 composed of paper, transparent plastic or equivalent flexible material can be overlaid and affixed to back support member 10 by glueing of the two sides and base of each of the plurality of date areas 14 to form a plurality of pocket-like receptacles 16 located in proximity to date areas 14 for the individual retention and display of one of a plurality of objects 20. The perimeter edges of front retaining member 23 can also be affixed to back support member 10 for neatness. Pocket openings 18 can be defined in front retaining member 23 for insertion of objects 20 into pocket-like receptacles 16 formed between front retaining member 23 and back support member 10. A plurality of apertures 22 can be cut into front retaining member 23 so that objects 20 retained within said pocket-like receptacles 16 are visible from the front of the calendar. For example, if dollar bills were being retained as objects within the calendar, aperture 22 could be oval in shape so that when each dollar bill was properly folded and inserted into receptacle 16, the picture of George Washington would be visible through the oval-shaped aperture which could correspond in size and shape to the oval picture of George Washington. When a transparent material is utilized as a front retaining member 23, apertures 22 would not be necessary since the objects to be retained would be easily visible for display purposes. Pocket 29 illustrates the use of transparent material as front retaining member 23. Each date area 14 has associated with it a calendar indicia number 12 signifying the date of the month in sequential order, the date areas further arranged to form a plurality of rows. In the embodiment illustrated the calendar indicia are imprinted on the front retaining member 23 although such imprinting can be made on back support member 10 for example when a transparent front retaining member is utilized. Attached to the top of back support member 10 is hanging ring 21 to assist in hanging the calendar to a wall.

In a further embodiment, the retaining means can be comprised of a plurality of individual pocket-like receptacles, each located over a date area 14, and each affixed over back support member 10 along the pocket-like receptacle's base and two sides, or along the pocket-like receptacle's base, one side and top edge, by glueing or equivalent means.

When money is inserted within the pocket-like receptacles of the calendar, the calendar can serve as a calendar-bank to encourage the habit of saving on a daily basis.

Figure 2:
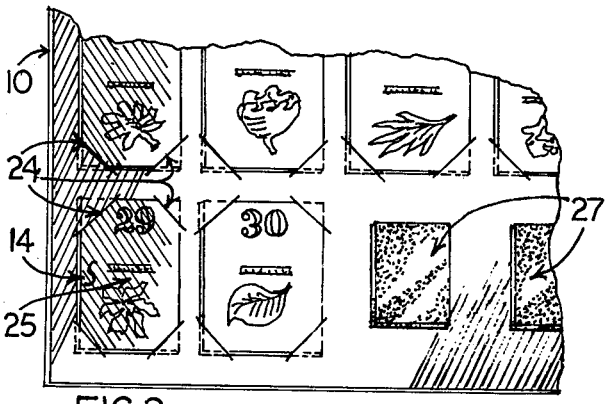
FIG. 2 illustrates a sectional view of the embodiments of the calendar device of this invention utilizing slits cut into the back support member and an adhesive coating as retaining means for a plurality of objects.

FIG. 2 illustrates a sectional view of the embodiment of the calendar device of this invention utilizing diagonal slits 24 incised into back support member 10 at the corners of date area 14 for retention of objects such as insertable card 25. FIG. 2 also illustrates another embodiment wherein the retaining means can be adhesive coating 27 such as two-sided tape or equivalent applied to each date area of the calendar's back support member 10 and on which objects to be retained are affixed, and which, when the current date is reached, can be peeled off, reversed, and affixed onto the date area on the object's reverse side. These objects can be in position when the calendar is sold or marketed, and in one embodiment can have a question or riddle printed on one side of each insertable card. On each day one can try to answer the question or riddle and the answer can be printed on the reverse side of the insertable card. The answer can also be in the form of a picture and be reinserted into the retaining means for display purposes. For example, if the question were "Who was the first president of the United States?", the opposite side of the insertable card could have a picture of George Washington and/or the words "George Washington." Utilized in this embodiment the calendar can serve as a learning tool especially for youngsters who may be intrigued by the suspense of a daily quiz.

Figure 3:
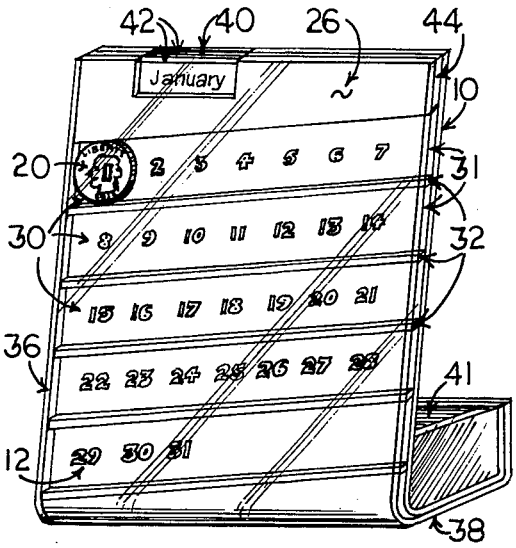
FIG. 3 illustrates a front view of the calendar device of this invention utilizing channels as retaining means for a plurality of objects.

FIG. 3 illustrates a front perspective view of the embodiment of the calendar device of this invention having a plurality of parallel channels 30 sloped at a downward incline to the horizontal, each channel having an opening 31 at one side for insertion of disk-like objects, each object being retained within the channel in a date area position relative to the current day of the month. Side support member 36 prevents object 20 from exiting out the lower end of each channel. The structure of this embodiment can be constructed of firm plastic, transparent synthetic resin material such as sold under the trademark Plexiglass or equivalent material. Seen in this view is back support member 10 over which is placed front support member 26. Between back support member 10 and front support member 26 are a plurality of parallel channels 30 and channel dividers 32 positioned at the same angle to the horizontal as channels 30. As objects are inserted through channel openings 31, they roll down the incline of channel dividers 32 and come to rest either in front of or behind calendar indicia number 12 depending on whether the indicia number is imprinted on back support member 10 or on transparent front support member 26. When calendar indicia numbers 12 are imprinted on transparent front support member 26, the inserted objects enable the indicia numbers in front of the objects to stand out in a more distinguishable manner. The calendar device is designed, when coins or disk-like objects are utilized as objects, to accept coins of the same denomination or disk-like objects of the same size. Object 20, a coin, is shown in position within the first date area of the calendar. The structure of this calendar, by necessity being heavier than the wall-hanging embodiment illustrated in FIGS. 1 and 2, can have a wall-hanging hook on the back of back support member 10 or equivalent support means such as base support member 38 also illustrated in FIG. 4 to hold it in an upright position, for example, on a desk top. The embodiment of this calendar device is not limited in use to either one particular month or one calendar year. Located between front support member 26 and back support member 10 is month-year calendar indicia retaining area 40 within which can be a plurality of card members 42 imprinted with the twelve months of the year. A sequential series of upcoming years of such size and shape such that the appropriate month and year card members can be displayed simultaneously within month-year calendar indicia retaining area 40 can also be utilized. Other equivalent means of displaying the current month and year can also be utilized without departing from the spirit or scope of the calendar device of this invention. The calendar as described can also include container 41 illustrated in FIG. 3 located above base support member 38. Top member 44 is affixed by glueing or equivalent means to the top of front support member 26, top of back support member 10, and top of side support member 36.

Figure 4:
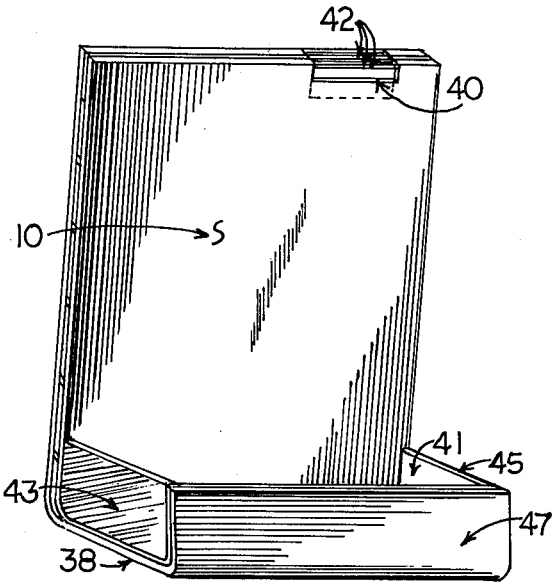
FIG. 4 illustrates a rear view of the device illustrated in FIG. 3.

FIG. 4 is a rear view of the calendar device illustrated in FIG. 3 showing base support member 38, back support member 10 and container 41, thereupon.

Figure 5:
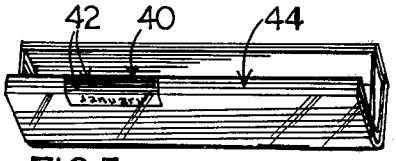
FIG. 5 illustrates a top view of the device illustrated in FIG. 3.

FIG. 5 is a top view of the device illustrated in FIG. 3 showing top member 44 and calendar indicia retaining space 40 containing card members 42.

Figure 6:
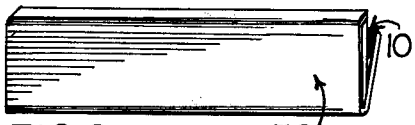
FIG. 6 illustrates a bottom view of the device illustrated in FIG. 3.

FIG. 6 is a bottom view of the device as illustrated in FIG. 3 showing back support member 10 and base support member 38.

Figure 7:
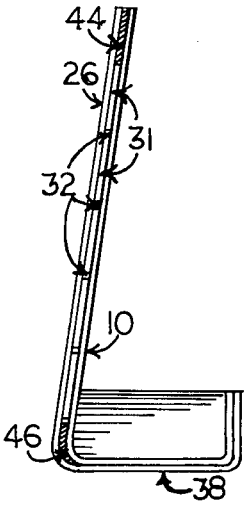
FIG. 7 illustrates a left side view of the device illustrated in FIG. 3.

FIG. 7 is a right side view of the device illustrated in FIG. 3 showing channel openings 31, front support member 26, channel dividers 32, back support member 10, base support member 38, bottom member 46 which joins the front support member to the back support member, and top member 44.

Figure 8:
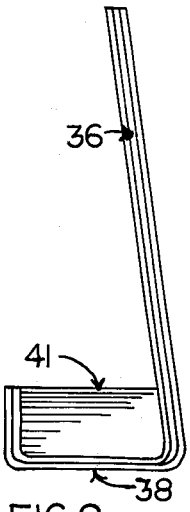
FIG. 8 illustrates a right side view of the device illustrated in FIG. 3.

FIG. 8 is a left side view of the device as illustrated in FIG. 3 showing side support member 36 which retains objects within channels, and base support member 38.

Figure 9:
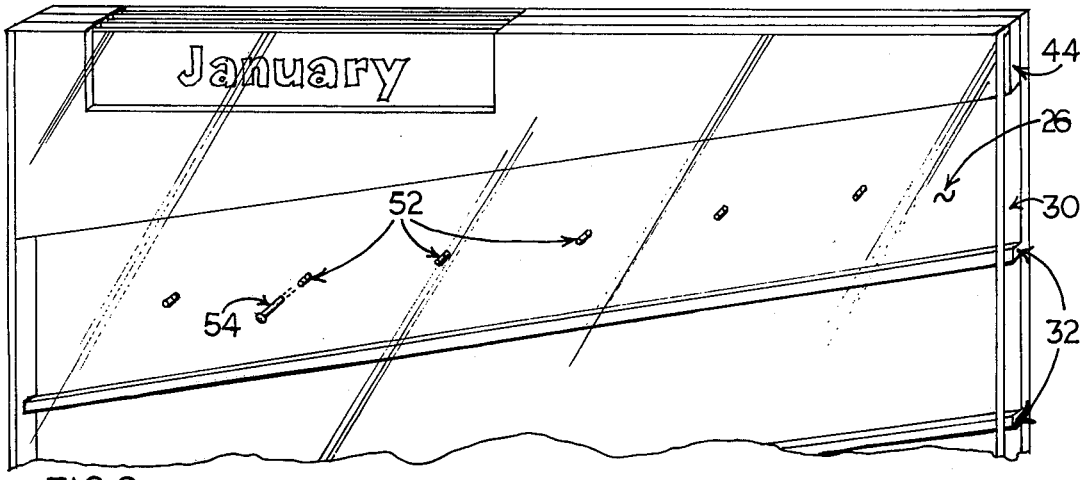
FIG. 9 illustrates a sectional view of the embodiment of the calendar device utilizing channels and having apertures defined in the front support member for receipt of a peg.

FIG. 9 illustrates an alternative embodiment of the calendar device of this invention illustrated in FIG. 3 utilizing a plurality of parallel channels for the receipt of disk-like objects such as coins or equivalent. Illustrated is top channel 30 with a series of six apertures 52 defined within front support member 26. Associated with each date area within top channel 30 with the exception of the first leftmost date area are apertures 52. Peg 54 is illustrated in position over one of apertures 52. Also notable in this view is that channel dividers 32 do not make contact with front support member 26. Also seen in this view is that top member 44 extends to make contact with the front support member 26 only at the very top thereby allowing transparent date sheet 56 illustrated in FIG. 10 to be inserted immediately behind front support member 26.

Figure 10:
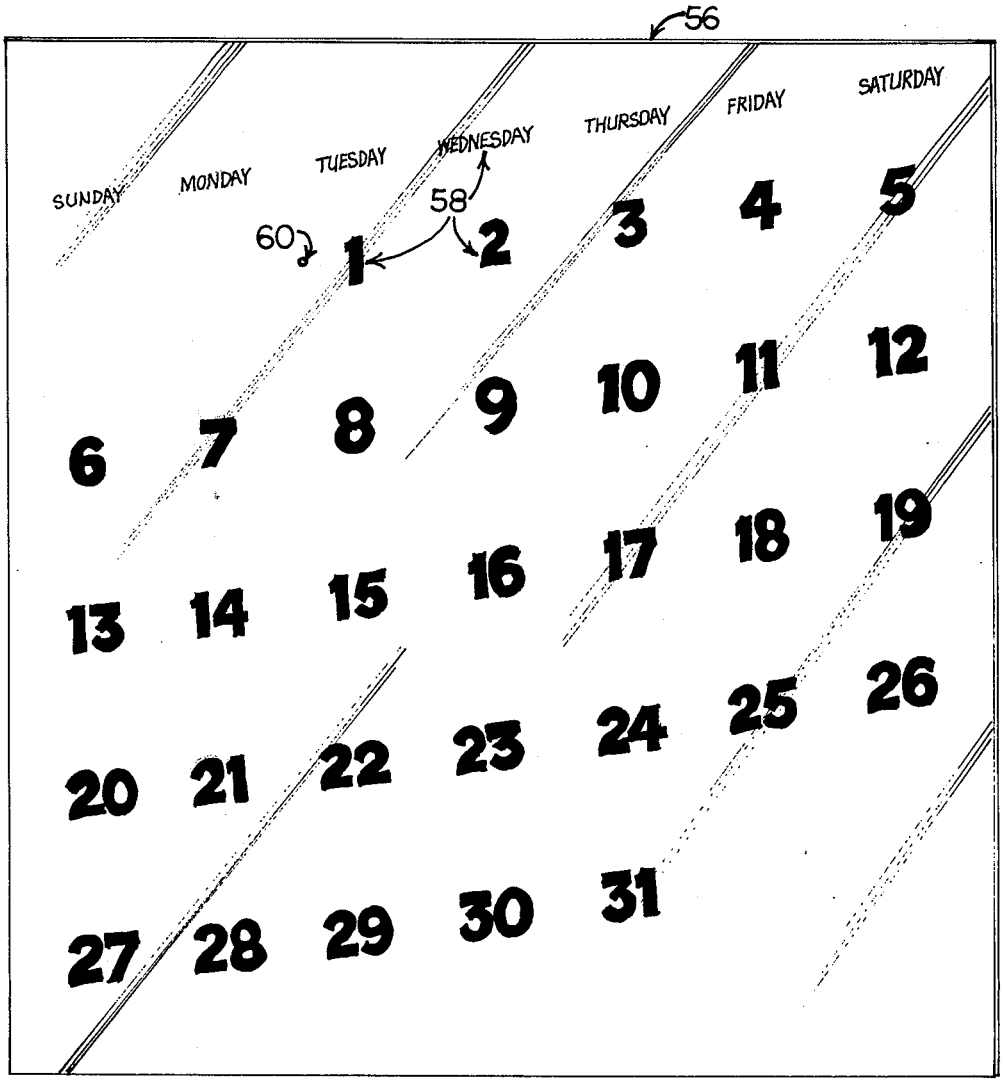
FIG. 10 illustrates a transparent date sheet.

Seen in FIG. 10 is transparent date sheet 56 on which are imprinted the calendar indicia numbers and the days 58 of the week set out in corresponding relation to the date areas defined within the channels of the calendar. This embodiment requires seven different transparent date sheets to be individually used, each one having the first date of the month beginning on a different weekday. Each transparent date sheet has an aperture before the first date of the month except for that transparent date sheet when the first date of the month occurs in the leftmost position in the first date area of the calendar. Transparent date sheet 56 illustrated in FIG. 10 shows the first date of the month positioned under Tuesday and shows aperture 60 immediately before that first date of the month for receipt of peg 54. When the appropriate transparent date sheet is in position between the front support member and the channel dividers, peg 54 can be inserted through both the aperture in the front support member and the aperture in the transparent date sheet before the first date of the month thereby preventing the inserted objects from rolling to the end of the channel and causing the objects to remain in position behind the first date of the month and successive objects inserted to roll in position behind sequential calendar indicia numbers.

Although the present invention has been described with reference to particular embodiments, it will be apparent to those skilled in the art that variations and modifications can be substituted therefor without departing from the principles and spirit of the invention.

I claim:

1. An object retaining and display calendar comprising:

a back support member;

a plurality of parallel dividers, sloped downward to the horizontal, affixed to said back support member to form a plurality of parallel channels each having an upper and lower end;

a plurality of date areas associated with calendar indicia in sequential order, arranged in a plurality of parallel rows sloped downward to the horizontal, each of said rows proximately and correspondingly positioned in relation to one of said channels, said date areas being in an overlying relationship to said back support member;

means for blocking the lower end of said channels; and a substantially transparent front support member affixed at its top and bottom in a face-to-face relationship with said back support member, said channel dividers and said channel end blocking means interposed therebetween.

2. A calendar device as recited in claim 1 wherein said rows of calendar indicia are imprinted upon said back support member, each row being correspondingly positioned within one of said channels.

3. A calendar device as recited in claim 1 wherein said rows of calendar indicia are imprinted upon said front support member, each of said rows being positioned correspondingly proximate with one of said channels.

4. A calendar device as recited in claim 1 wherein said channel blocking means is a side support member disposed at said lower ends of said channels and interposed to facilitate affixation of said front and back support members.

5. A calendar device as recited in claim 4 wherein said device further includes:

said channel dividers positioned in a spaced relation at a distance from said front support member;

a transparent date sheet having said sloped calendar indicia rows imprinted thereon, fixably positioned in communication between said front support member and said channel dividers, each of said calendar indicia rows being positioned correspondingly proximate with one of said channels;

a top member interposed and affixed to the top of said front and back support members;

a bottom member interposed and affixed to the base of said front and back support members; and means to support said calendar.

6. A calendar device as recited in claim 5 wherein said support means includes a base support member having upwardly inclined sidewalls to form a container.

7. A calendar device as recited in claim 5 further including:

a plurality of transparent calendar indicia date sheets having an aperture before and adjacent to the first of said date areas of said date sheets;

at least five apertures within said front support member correspondingly positioned in relation to the uppermost of said plurality of channels and correspondingly positioned in relation to apertures of a positioned date sheet to communicate therewith; and at least one peg member for insertion through said front support member apertures, said date sheet apertures, and said channel to meet said back support member to retain an object progressing down said channel.

* * * * *